US005381958A

United States Patent [19]

Koblmüller et al.

[11] Patent Number: 5,381,958

[45] Date of Patent: Jan. 17, 1995

[54] APPARATUS FOR DESTROYING UNWANTED VEGETATION IN THE REGION OF TRAVEL WAYS

[75] Inventors: Günther Koblmüller, Breitenfurt; Michael Martin, Mödling, both of Austria

[73] Assignee: P.C. Wagner Elektrothermit-Schweissgesellschaft, Vienna, Austria

[21] Appl. No.: 153,233

[22] Filed: Nov. 15, 1993

[51] Int. Cl.[6] ..... E01H 11/00

[52] U.S. Cl. ..... 239/136; 239/174; 104/279

[58] Field of Search ..... 239/173, 174, 130, 135, 239/136; 104/279

[56] References Cited

U.S. PATENT DOCUMENTS

| | | | |
|---|---|---|---|
| 1,142,788 | 6/1915 | Allen | 104/279 |
| 1,238,861 | 9/1917 | Williams et al. | 239/173 |
| 1,487,367 | 3/1924 | Williams et al. | 239/173 |
| 1,594,709 | 8/1926 | Bubb et al. | 239/173 |
| 1,610,556 | 12/1926 | Kirkland | 239/174 |
| 1,767,828 | 6/1930 | Wratten | 239/173 |
| 1,832,030 | 11/1931 | Kirkland | 239/174 |

*Primary Examiner*—Karen B. Merritt
*Attorney, Agent, or Firm*—Anderson Kill Olick & Oshinsky

[57] ABSTRACT

An apparatus for destroying unwanted vegetation in the region of travel ways that includes a steam generating unit, which is mounted on a vehicle and to the steam output of which are connected steam nozzles which form at least one nozzle bar. The at least one nozzle bar extends transversely to the direction of travel essentially across the width of the travel way and is mounted beneath the bogie of the vehicle by a central support of adjustable height. The apparatus further includes lateral support portions with nozzle bar sections which are pivotable about a shaft extending in the direction of travel, as well as adjustable vertically and laterally. The central support and the lateral support portions are constructed as an open-bottomed hood with a top, side walls and end walls. The at least one nozzle bar is mounted on the hood top for displacement in the direction of travel and for pivoting about a pivot shaft extending transversely to the direction of travel, and has at least two rows of nozzles inclined at different angles to the direction of travel.

6 Claims, 2 Drawing Sheets

APPARATUS FOR DESTROYING UNWANTED VEGETATION IN THE REGION OF TRAVEL WAYS

BACKGROUND OF THE INVENTION

The invention concerns an apparatus for destroying unwanted vegetation in the region of travel ways, in particular on track beds, with a vehicle, in particular a railway vehicle, on which is mounted a steam generating unit to the steam output of which are connected steam nozzles which form at least one nozzle bar which extends transversely to the direction of travel essentially across the width of the travel way and which is mounted beneath the bogie of the vehicle by means of a support of adjustable height, wherein there are further provided lateral support portions pivotable about a shaft extending in the direction of travel, with nozzle bar sections which extend in extension of the nozzle bar.

Up to now, unwanted vegetation e.g. on track beds is usually destroyed with chemicals. The increasing environmental awareness results in increased sensitization to chemical agents of destruction, because even so-called "environmentally friendly" agents not only remove the vegetation, but also seriously disturb the biological equilibrium of the soil and contaminate the groundwater.

It is already known from U.S. Pat. No. 1,238,861 that a steam locomotive can be fitted on the underside of its bogie with a support of adjustable height spanning the track, for steam-conducting pipes from which steam can be sprayed through nozzles onto the ballast bed. The support extending in the longitudinal direction of the bogie is adjustable in height and is provided outside of the rails with two hinged lateral portions which also carry steam pipes and which sweep over the lateral sections of the ballast bed. The known design is structurally relatively elaborate owing to the plurality of steam nozzle pipes which are distributed over the whole area of the support, and has poor performance due to the relatively unhindered exit of steam in all directions.

DE-A-3639705 discloses a steam generating unit capable of traveling on a flat-bed truck for destroying weeds, in which the steam-spraying unit, a reflector of parabolic cross-section is provided. The reflector has, at its center, a spray pipe and is connected, by a hose, to a carriage provided with wheels or skids for moving over the ground.

The invention aims to provide an apparatus of the kind indicated hereinbefore which offers excellent environmental compatibility with efficient destructive action by using steam, i.e. it neither pollutes the groundwater nor disturbs the biological equilibrium of the soil, and which owing to improved design compared with the known construction ensures more efficient and more economical treatment even of long travel ways.

SUMMARY OF THE INVENTION

This aim is achieved according to the invention by the fact that the support is constructed as an open-bottomed hood with a top, side walls and end walls, that the nozzle bar is mounted on the hood top for displacement in the direction of travel, preferably in the first front third of the extent of the support in the direction of travel, and for pivoting about a pivot shaft extending transversely to the direction of travel, and comprises at least two rows of nozzles inclined at different angles to the direction of travel, and that the pivotable lateral support portions are also each constructed as a hood and their pivot shaft is mounted on the vehicle for both vertical displacement and displacement transversely to the direction of travel.

According to an embodiment of the invention which with respect to operation is specially preferred for the treatment of switch zones of tracks, it is provided that the support is split in the longitudinal center plane of the vehicle, wherein each support portion is also provided with a side wall in the region of the longitudinal center plane and independently adjustable in height.

Preferably, the side walls and end walls of the support or of each support portion are formed in each case by a heat-insulating double jacket.

According to a further characteristic of the invention, the steam generating unit is formed by a steam boiler with output pressure regulator supplied from a water tank by a pump, wherein the pump is supplied electrically by a diesel power unit and the steam boiler is heated by a gas burner supplied from gas bottles.

The construction according to the invention has the advantage that the steam is discharged from the steam nozzles in a region of the length of the vehicle or of the support for the nozzle bar which is optimal for steam distribution at a predetermined travelling speed, wherein the optimum steam distribution can easily be regulated by adjusting the nozzle bar. The hood, which opens only towards the ground, ensures that the steam does not escape prematurely, but is effectively distributed over the whole extent of the hood. The effect of steam blasting on the plants is further increased by the special orientation of the two rows of nozzles. Due to the heat-insulating double jacket of the side walls and end walls of the support, the maintenance of an effective steam temperature within the hood is ensured.

BRIEF DESCRIPTION OF THE DRAWINGS

Further characteristics and advantages of the invention are described in more detail below by a practical example with reference to the drawings, which show.

DETAILED DESCRIPTION OF THE PREFERRED EMBODIMENT

Figure 1:
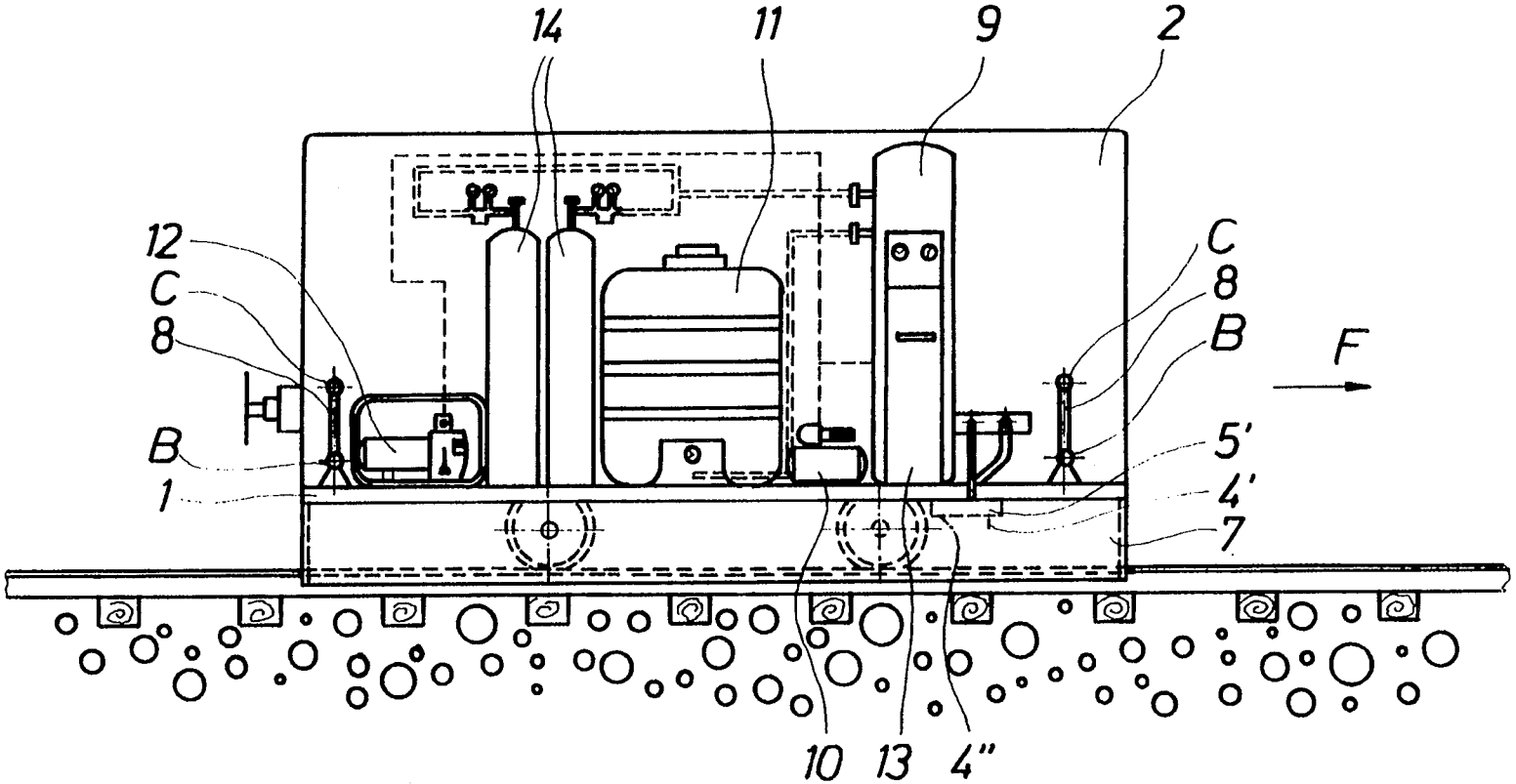
FIG. 1 a schematic longitudinal section through an apparatus according to the invention, FIG. 2 a schematic cross-section of the apparatus according to FIG. 1, and FIG. 3 a detail of the apparatus through the line III—III in FIG. 2.
Figure 3:
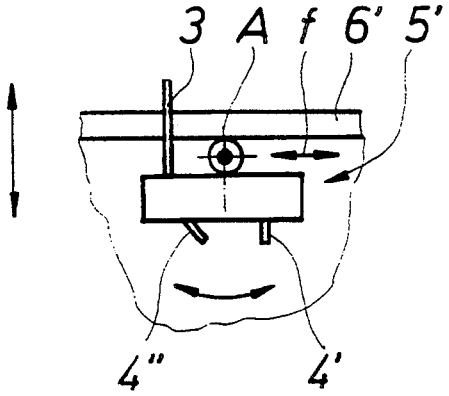

According to the Figures, on a railway vehicle 1 is mounted a steam generating unit 2 which supplies steam nozzles 4', 4'' via flexible pipes 3. The steam nozzles 4', 4'' are held in nozzle bar sections 5' which are arranged transversely to the direction of travel in mutual extension and which each comprise at least two rows of nozzles. As FIG. 3 shows, the nozzles 4' of the front row in the direction of travel are oriented vertically in the horizontal position of the nozzle bar, whereas the nozzles 4'' of the back row are oriented obliquely, so that the plants are acted upon by the steam nozzles even in their lower region. The nozzle bar sections 5' are each mounted by means of a hydraulically, electrically or mechanically height-adjustable support portion 6 on the lower side of the frame of the railway vehicle 1. As can be seen in particular from FIG. 3, each nozzle bar section 5' is mounted on the associated support portion 6 for pivoting by means of a shaft A extending transversely to the direction of travel and displaceable in the direction of travel e.g. in guides, not shown (arrow f), in the first front third of the extent of the support (cf. FIG. 1).

Figure 2:
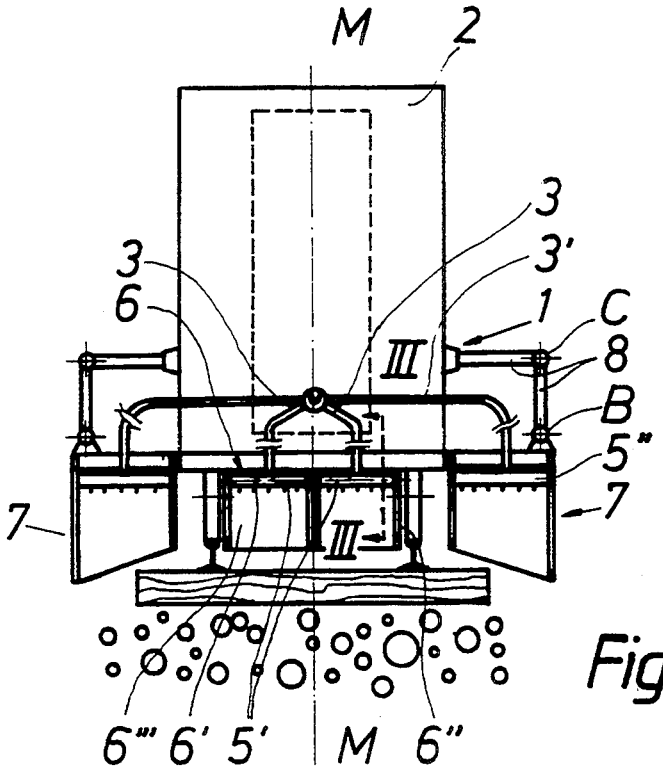

As can be seen from FIG. 2, the support in the embodiment shown is split in relation to the longitudinal center plane M of the vehicle, wherein each support portion 6 is provided with a top 6', side walls 6'' and end walls 6''', so that each support portion 6 has the form of a hood which opens towards the ground. Splitting the support in two makes it possible to adjust the height of each of the two support portions 6 or subject them to steam independently, which proves to be particularly advantageous in an economic respect, e.g. for the treatment of switch regions of the track. The side walls 6'' and end walls 6''' are constructed as double jackets with insulating material in between for thermal insulation. It goes without saying that the support and the nozzle bar may also be constructed in one piece.

As can further be seen from FIG. 2, on the bogie are also mounted two lateral support portions 7 which are constructed analogously to the central support portions 6 and mounted pivotably on a shaft B extending in the longitudinal direction of the vehicle. The shaft B is mounted on the vehicle 1 for both adjustment in height and displacement transversely to the direction of travel by means of an additional shaft C, through the intermediary of correcting cylinders 8. The nozzle bar sections 5'' of the lateral support portions 7 are arranged in extension of the nozzle bar sections 5' and supplied via flexible steam pipes 3'. With the lateral support portions 7, the side portions of the ballast bed located outside of the rails are swept. The outer side walls of the side portions 7 can be made longer than the inner side walls. It goes without saying that the flexible steam pipes 3, 3', which extend to the individual nozzle bar sections 5', 5'' of the support portions 6, 7, are provided with valves or regulating means, not shown, for steam throughput, so that they can be switched or regulated separately.

The steam generating unit 2 is formed by a steam boiler 9 which is supplied by a pump 10 from a water tank 11. The pump 10 is here supplied electrically from a diesel power unit 12, and the steam boiler 9 is heated by a gas burner 13 which is supplied from gas bottles 14.

It goes without saying that within the scope of the concept of the invention, many modifications of the embodiment shown are possible; thus, in particular the type and design of the steam nozzles as well as their number or the number of rows of steam nozzles on the nozzle bar and also the orientation of the steam nozzles relative to the direction of travel can be altered compared with those shown. But it is essential that there is at least one row of vertical nozzles and one row of obliquely extending nozzles. There may also be more than one nozzle bar. Similarly, the construction of the steam generating unit is indicated only by way of example; any known steam generating unit can be used.

During practical operation of the apparatus, it turned out that the travelling speed is to be selected in such a way that action of the steam on the plants must take place for at least 2 s, so that the plants are brought to a temperature of at least 70° in order to ensure transformation of the plant protein. In general it is endeavoured to produce an air temperature of 95° to 100° C. beneath the hoods. The position of the nozzle bar 5 can be optimally adjusted in the direction of travel preferably within the first front third of the support 6 by means of an adjusting mechanism, not shown, e.g. on rails.

We claim:

1. An apparatus for destroying unwanted vegetation in a region of railway track beds and mountable on a railway vehicle having a bogie, said apparatus comprising:

a steam generating unit having a steam output and mountable on the vehicle;

a plurality of steam nozzles connectable to said steam output and forming at least one nozzle bar, said at least one nozzle bar being mountable beneath the vehicle bogie to extend transversely to a travel direction of the vehicle substantially across a width of a track bed, and said at least one nozzle bar comprising at least two rows of nozzles inclined at different angles to the travel direction; and support means for mounting said at least one nozzle bar to the vehicle bogie, said support means comprising:

a central support having an adjustable height and including a top, side walls and end walls, which together form an open-bottom hood, and a first pivot shaft extendable transverse to the travel direction, said at least one nozzle bar being mounted on said top for displacement in the travel direction and for pivotal movement about said pivot shaft; and first and second lateral supports arranged on opposite sides of said central support, respectively, for supporting first and second nozzle bar sections, respectively, which are co-extensive with said at least one nozzle bar, each of said lateral supports having an open-bottomed hood shape and including a second pivot shaft for pivotally supporting said first and second nozzle bar sections, respectively, and said second pivot shaft extending in the travel direction, each said second pivot shaft being displaceable vertically and in a direction transverse to the travel direction.

2. An apparatus according to claim 1, wherein said central support has first and second portions separated by a longitudinal central plane of the vehicle, each portion having a side wall, which extends in a region of the central plane and is height-adjustable independently of the side wall of the other portion.

3. An apparatus according to claim 1, wherein said side and end walls are formed each as a heat-insulated double jacket.

4. An apparatus according to claim 1, wherein a first nozzle row of said nozzle bar includes nozzles which extend vertically, and a second nozzle row of said nozzle bar includes nozzles which extend at an angle to a vertical plane.

5. An apparatus according to claim 1, wherein said steam generating unit comprises a boiler, a water tank, a pump for supplying water from said water tank to said boiler, a diesel power unit for driving said pump, a gas burner for heating said boiler, and at least one gas bottle for storing gas for said gas burner.

6. An apparatus according to claim 1, wherein said at least one nozzle bar is mounted on said central support for displacement in a front portion of said central support, said front portion having a length approximately equal to one third of an extent of said central support in the travel direction.

* * * * *